US009610680B2

(12) United States Patent
Diamond

(10) Patent No.: US 9,610,680 B2
(45) Date of Patent: Apr. 4, 2017

(54) DRILL BIT STORAGE BOX WITH AN INTEGRAL GAUGE

(71) Applicant: Norman Diamond, Deerfield, IL (US)

(72) Inventor: Norman Diamond, Deerfield, IL (US)

(73) Assignee: NEXTEK CORPORATION, Deerfield, IL (US)

( * ) Notice: Subject to any disclaimer, the term of this patent is extended or adjusted under 35 U.S.C. 154(b) by 63 days.

(21) Appl. No.: 14/727,155

(22) Filed: Jun. 1, 2015

(65) Prior Publication Data

US 2015/0352709 A1 Dec. 10, 2015

Related U.S. Application Data

(60) Provisional application No. 61/997,685, filed on Jun. 9, 2014.

(51) Int. Cl.
*B65D 85/00* (2006.01)
*B25H 3/00* (2006.01)

(52) U.S. Cl.
CPC ..... *B25H 3/003* (2013.01)

(58) Field of Classification Search
CPC ..... B25H 3/00; B25H 3/003; B25H 3/02
USPC ..... 206/349, 350, 379, 372
See application file for complete search history.

(56) References Cited

U.S. PATENT DOCUMENTS

| | | | | |
|---|---|---|---|---|
| 5,344,012 | A * | 9/1994 | Matthews | B25H 3/06 206/372 |
| 6,176,559 | B1 * | 1/2001 | Tiramani | B25H 3/023 280/47.19 |
| 6,349,827 | B1 * | 2/2002 | Feder | B25H 3/003 206/373 |
| D632,803 | S * | 2/2011 | Motadel | D24/229 |
| 8,348,067 | B2 * | 1/2013 | Brown | A47F 7/0028 132/73 |
| 2005/0103783 | A1 * | 5/2005 | Bergum | B25H 3/023 220/23.86 |
| 2007/0194071 | A1 * | 8/2007 | Hollinger | B60R 7/00 224/542 |

* cited by examiner

*Primary Examiner* — Steven A. Reynolds
*Assistant Examiner* — Javier A Pagan
(74) *Attorney, Agent, or Firm* — Justin Lampel

(57) ABSTRACT

A drill bit storage box with an integral gauge is provided. The storage box has a hinged top surface, a bottom, slanted sides and an interior. The top surface has a plurality of various sized openings for receiving drill bits, with each opening corresponding to a specific size drill bit. The interior of the storage box has a plurality of holding bins located beneath the plurality of openings of the top surface. When a drill bit is placed through the opening which corresponds to the exact diameter of the drill bit on the top surface and the drill bit is released, the drill bit falls into the correct corresponding holding bin within the interior of the storage box. In this manner, a random number of drill bits may be sized and stored for future use.

12 Claims, 6 Drawing Sheets

DRILL BIT STORAGE BOX WITH AN INTEGRAL GAUGE

CROSS REFERENCE TO RELATED APPLICATIONS

The following application is based on and claims the priority benefit of U.S. provisional application Ser. No. 61/997,685 filed Jun. 9, 2014; the entire contents of which are incorporated by reference.

BACKGROUND OF THE INVENTION

A drill bit storage box with an integral gauge is provided. The storage box has a hinged top surface, a bottom, slanted sides and an interior. The top surface has a plurality of various sized openings for receiving drill bits, with each opening corresponding to a specific size drill bit. The interior of the storage box has a plurality of holding bins located beneath the plurality of openings of the top surface. When a drill bit is placed through the opening which corresponds to the exact diameter of the drill bit on the top surface and the drill bit is released, the drill bit falls into the correct corresponding holding bin within the interior of the storage box. In this manner, a random number of drill bits may be sized and stored for future use.

Wood, plastic and metal commercial and home workshops normally make use of manual and electric drills to make holes in various types of materials. The holes can often range from less than 1/16 inch to over 1/2 inch in diameter. Cutting these holes is often by means of a "drill bit", each with a unique diameter. A full complement of drill bits can have over twenty-five sizes, with often 1/64 inch separating adjacent sizes. This makes visual inspection difficult, as the drill bits are rarely or clearly marked as to their sizes.

To facilitate determining the size of a drill bit, gauges are sold which have a series of holes, each representing a specific drill bit size. When a set of drill bits are sold they often come in a case with means of storing a single bit of the sizes provided in the set.

In situations where a workshop has multiple copies of a drill bit of a specific size, storage cabinets are sold, with compartments to store multiple copies of several sizes of drill bits. However, there is no means against a drill bit being placed in the wrong compartment, due to simple visual inspection. The present device provides for accurate sizing of the drill bits and the storage thereof of multiple copies of each size within the device.

Boxes for storing drill bits have been invented in the past. For example, U.S. Pat. No. 6,631,802 to Hsu discloses a tool box drill bit retainer that provides for the containment of different diameter drill bits inside the tool box, the primary application of which is keeping larger size drill bits within the drill bit recess of the tool box. The improved structure of the drill bit retainer effectively enhances the orderly securing of drill bits in the tool box and increases product practicality.

Further, U.S. Pat. No. 5,071,005 to Hemmings discloses a shipping container for holding a variable number of drill bits immobile, thereby preventing potentially damaging contact of the drill bit points with interior walls of the container has a concave base section hingedly connected to a symmetrically-shaped lid section which is pivotable downwards into contact with the base to form a closed, rectangular box-like enclosure. Rows of cylindrical pins protrude upwards from the upper surface of the bottom wall of the base and are adapted to be insertably received in bores provided into the lower surface of an elongated, slab-shaped drill bit carrier, each row of pins thus holding a separate carrier in a horizontally fixed position relative to the base. A plurality of parallel vertically disposed, longitudinally spaced apart drill bit bores extending downward into each carrier from the flat upper surface of the carrier is adapted to insertably receive a plurality of drill bits, the shank of each drill bit being fitted with an annular insertion depth-limiting ring near the junction of the shank with the fluted cutting region of the drill bit. The lid is provided with a plurality of retainer plates which protrude downwards from the lower surface of the top wall of the lid. With the lid in a downward, closed position, as separate plate is positioned between adjacent pairs of drill bit bores, the lower surface of the plate being positioned just above the upper surface of insertion rings on bits positioned in the bores, thereby limiting upward movement of the rings and attached drill bits.

Still further, U.S. Pat. No. 5,878,882 to Kohagura discloses a tool box assembly having a first surface with a first aperture there through for retaining a tool (such as a drill bit) having a longitudinal axis. A second surface is provided having a second aperture there through for retaining the tool. The first surface is retained relative to the second surface whereby the tool may translate along the longitudinal axis thereof through the first aperture in the first surface and the second aperture in the second surface when the first surface is in a first position relative to the second surface land be restrained against translation along the longitudinal axis thereof when the first surface is in a second position relative to the second surface.

However, these patents fail to describe a drill bit storage box with an integral gauge which is easy to use and efficient as in the present application. Further, these patents fail to provide a drill bit storage box with an integral gauge having an interior holding bin for multiple copies of each size drill bit wherein the drill bit automatically falls into the correct drill bit holding bin for subsequent use.

SUMMARY OF THE INVENTION

A drill bit storage box with an integral gauge is provided. The storage box has a hinged top surface, a bottom, slanted sides and an interior. The top surface has a plurality of various sized openings for receiving drill bits, with each opening corresponding to a specific size drill bit. The interior of the storage box has a plurality of holding bins located beneath the plurality of openings of the top surface. When a drill bit is placed through the opening which corresponds to the exact diameter of the drill bit on the top surface and the drill bit is released, the drill bit falls into the correct corresponding holding bin within the interior of the storage box. In this manner, a random number of drill bits may be sized and stored for future use.

An advantage of the present drill bit storage box with an integral gauge is that the present device may be provided with a removable top surface having a plurality of drill size openings which accept SAE drill bit sizes and for which may be replaced with an alternative removable top surface having a plurality of drill size openings for accepting metric sized drill bits.

An advantage of the present drill bit storage box with an integral gauge is that the present device may have a hinged top surface, configured in a manner to allow the top surface to open and stay in a stable position of approximately one hundred and twenty degrees so as to permit retrieval of stored drill bits from the holding bins.

Yet another advantage of the present drill bit storage box with an integral gauge is that the present device has a latch on the front surface which automatically engages when the top surface is closed and for which is easily released permitting the top surface to be opened.

Still another advantage of the present drill bit storage box with an integral gauge is that the present device may have a storage drawer which may be temporarily secured to the bottom of the storage box for storing additional items.

Another advantage of the present drill bit storage box with an integral gauge is that the present drill bit storage box with an integral gauge may have a magnetic bottom which temporarily secures the drill bits and prevents the drill bits from accidently falling out of the drill bit box.

For a more complete understanding of the above listed features and advantages of the present drill bit storage box with an integral gauge reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A drill bit storage box with an integral gauge is provided. The storage box has a hinged top surface, a bottom, slanted sides and an interior. The top surface has a plurality of various sized openings for receiving drill bits, with each opening corresponding to a specific size drill bit. The interior of the storage box has a plurality of holding bins located beneath the plurality of openings of the top surface. When a drill bit is placed through the opening which corresponds to the exact diameter of the drill bit on the top surface and the drill bit is released, the drill bit falls into the correct corresponding holding bin within the interior of the storage box. In this manner, a random number of drill bits may be sized and stored for future use.

Figure 1:
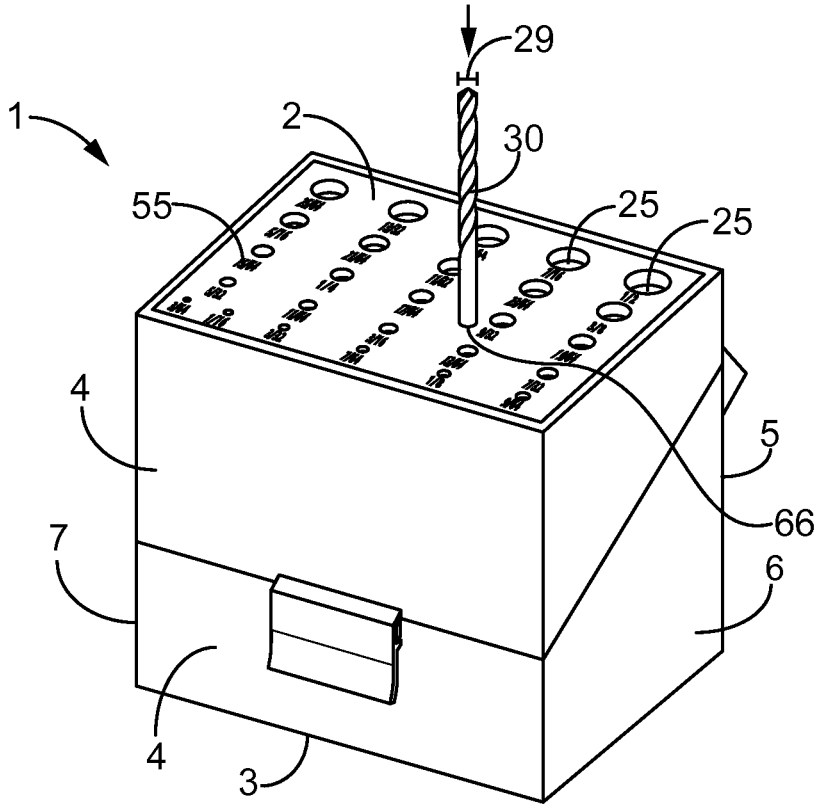
FIG. 1 illustrates a perspective view of the drill bit gauge and storage box wherein the top surface portion (or "lid) is closed and a drill bit is being inserted into an opening of the top surface of the storage box.

Referring now to FIG. 1, in an embodiment, a drill bit gauge and storage box 1 is provided. The drill bit gauge and storage box 1 may have a housing having a removable top 2, a bottom 3, a front 4, a back 5, a first side 6, a second side 7 and an interior 8 (FIG. 3) having a plurality of holding bins 10. Preferably, the housing is made from plastic, wood, metal or the like. It should be understood that the housing may be made from any suitable material. The top surface, having a plurality of precision openings, may be made of a material different from that of the housing. When it is desired to identify and/or store a drill bit 30 without knowing the size of the drill bit 30, the drill bit 30 may be placed through an appropriate opening 25 located on the removable top 2 of the device 1 wherein the drill bit 30 then falls into the interior 8 of the device 1 for future use. Indicia (distinctive printed markings) 55 representing a gauge may be associated with each of the openings 25 to allow a user to know the size of the drill bit 30. Further, matching indicia 49 (FIG. 3) may be associated with each of the holding bins 10 which store the drill bits 30. In an embodiment, the indicia 49 on the holding bins 10 may be listed in both SEA and metric so that if a user swaps out the removable top 2 the user may still use the holding bin 10 already inserted in the device 1. It should be understood that in an embodiment, the top 2 of the device 1 may not be removable, buy may be permanently affixed to the device 1 and not readily removable.

In an embodiment, the first side 6 and the second side 7 may be slanted such that the portion of the first side 6 and the second side 7 secured to the front 4 of the housing has a smaller height than the height of the first side 6 and the second side 7 at the back 5 of the device 1. Providing a slanted first side 6 and second side 7 allows a user to more easily grasp larger drill bits 30 which are secured toward the back 5 of the interior 8 of the housing and the smaller drill bits 30 which are secured toward the front 4 of the interior 8 of the housing. More specifically, the smaller drill bits 30 have a shorter height and therefore, the individual holding bins 10 (as described below) need to also be shorter toward the front 4 of the housing.

As stated above, in an embodiment, the top 2 of the housing may have a plurality of openings 25. The plurality of openings 25 may have varying diameters 26 (FIG. 2) which correspond to the diameters 29 (FIG. 1) of the various drill bits 30. In particular, the diameters 26 of the openings 25 of the top 2 of the housing may be identical to the diameter 29 of the drill bit 30 for which the opening 25 is intended to receive such that the proper drill bit 30 just barely fits into its respective opening 25. In an embodiment, a first top 2 may have standard US sized openings 25 whereas an alternate top 2 (FIG. 4) may have openings 25 based on metric drill bit sizes 30.

Figure 4:
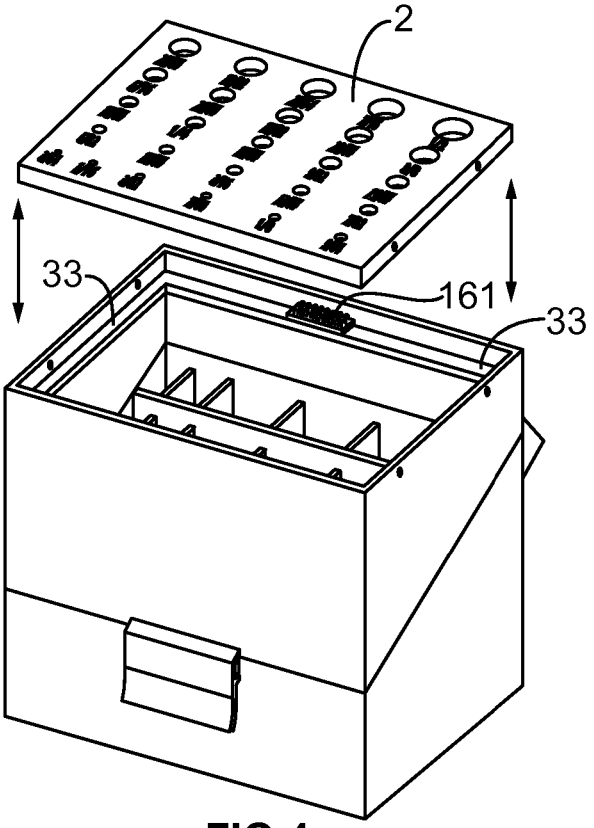
FIG. 4 illustrates a perspective view of the drill bit gauge and storage box wherein the removable top surface is being installed on or removed from the main box portion.

As shown in FIG. 4, in an alternative embodiment, the top 2 of the housing may be removable from the main body housing. In particular, the top 2 of the housing may rest on a ridge 33 located within the interior 8 of the device 1 near the top of the device 1, running along the perimeter of the housing. The top 2 of the device 1 may be removed by pulling the top 2 upward. To insert the same or alternative top 2 onto the box, the reverse is done and top 2 may therein rests, via gravity, on the ridge 33. In an alternative embodiment, the top 2 may be secured to the main housing of the box via a hook a loop fastener 161 located on the ridge 33 which mates with a corresponding hook or loop fastener located on the underside of the removable top 2 along the perimeter of the removable top 2. The top 2 may be removed to, for example, replace a top 2 having standard US sized openings 25 with a top 2 having openings 25 based on metric drill bits 30.

Figure 3:
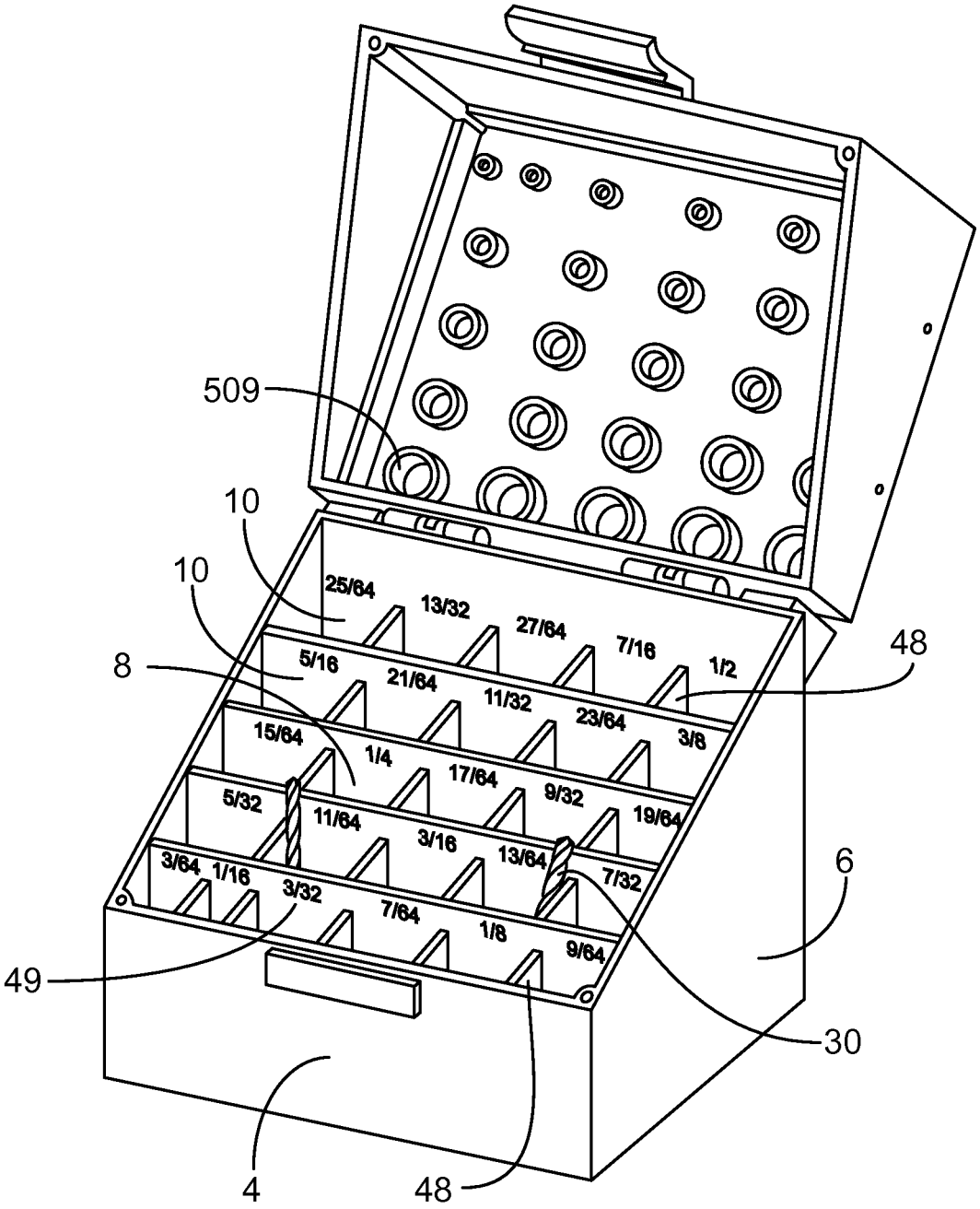
FIG. 3 illustrates a top view of the drill bit gauge and storage box wherein the top surface is rotated in the open position and the interior of the box having the holding bins is illustrated, with each bin in the interior of the box marked with drill bit diameter dimension.
Figure 9:
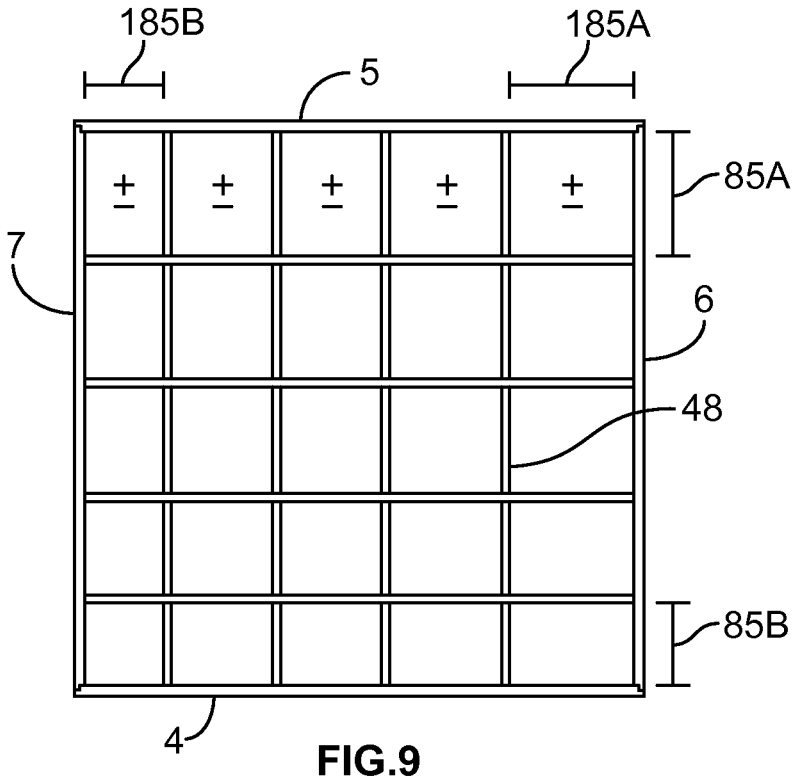
FIG. 9 illustrates a top view of the interior of the storage box, showing the preferred configuration of bins.

Referring now to FIGS. 3 and 4, in an embodiment, as stated above, the interior 8 of the housing may have a plurality of holding bins 10 created by a plurality of dividers 48. The plurality of holding bins 10 may be generally elongated vertical generally square-shaped compartments of various sizes which are located directly below the openings 25 of the top 2 of the device 1. Preferably, the size of each of the plurality of holding bins 10 corresponds to the size of the openings 25 located directly above that specific holding bin 10. More specifically, the larger the opening 25 of the top 2 of the device 1 the larger the holding bin 10 located below that opening 25 so as to better accommodate the drill bits 30 of various sizes. As illustrated in FIG. 9, a length 85A of one of the holding bins 10 located near the back 5 of the device may be greater than a length 85B of a holding bin 10 located near the front 4 of the device 1, in order to contain several drill bits, having larger diameters. More specifically, the closer the holding bin 10 is to the front 4 of the device 1 the smaller the length 85B of that holding bin 10. Further, in an embodiment, each of the individual holding bins may have a width 185 wherein the widths 185A and 185B may be of various sizes to accommodate the greater thicknesses of the drill bits 30 assigned to each individual holding bin. As illustrated in FIG. 9, in an embodiment, the width of the individual holding bins may increase as the diameter 29 of the brill bits 30 increase.

Figure 8:
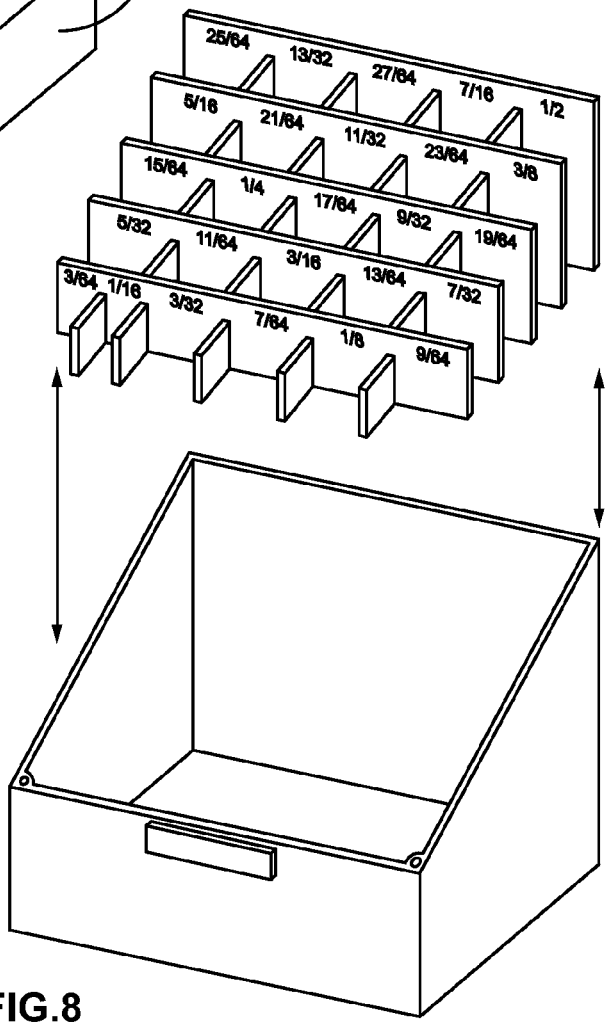
FIG. 8 illustrates an embodiment wherein the holding bin section is being removed from the interior of the storage box.
Figure 10:
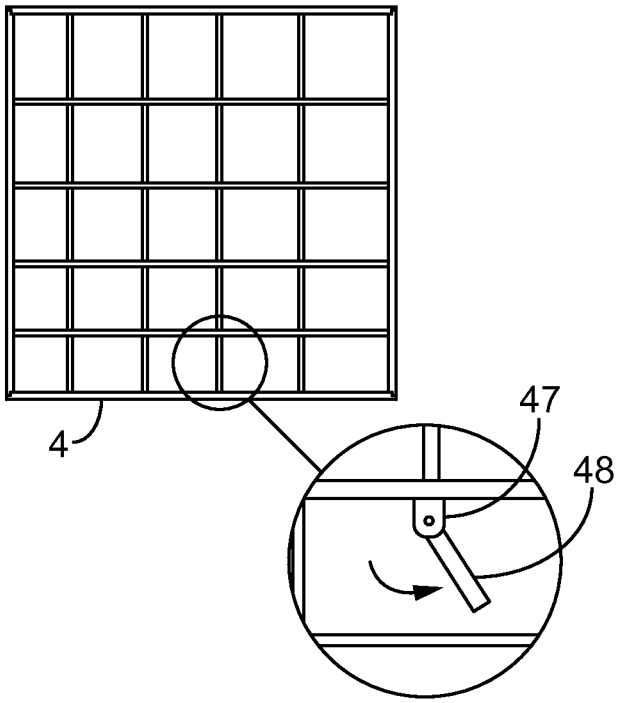
FIG. 10 illustrates a top view of an alternative embodiment of the holding bins wherein dividers of the holding bins are pivoted to create a different storage area for inserted drill bits.

Referring now to FIG. 8, in an embodiment, the plurality of holding bins 10 may be temporarily removed from the interior 8 of the housing. In particular, in this embodiment, the holding bins 10 may be secured as a single unit of a plurality of dividers 48. Allowing the holding bins 10 to be removed from the interior 8 of the housing allows a user to clean the interior of the box, repair or exchange a damaged holding bin 10 for an undamaged holding bin structure 10, or allows a user to swap out a holding bin 10 having specific sizes for a holding bin structure 10 having different sized openings. Referring now to FIG. 10, in an alternative embodiment, the holding bin 10 may be constructed of a series of individual dividers 48 in which at least one of the dividers 48 may be rotated (being attached at one end) at a pivot 47 so as to allow a user to make a specific containment area larger or smaller.

Referring again to FIG. 9, in an alternative embodiment, the bottom 3 of the drill bit gauge and storage box may be magnetic. In this embodiment, the magnetic nature of the bottom 3 may allow the drill bits 30 to be lightly attracted to the bottom 3 (when stored within the interior 8) of the housing. As a result, the drill bits 30 remain temporarily secured within the holding bins 10 in the interior 8 of the housing in the event that the storage box 1 is dropped, turned upside down or otherwise disrupted. The magnet of the bottom 3 is preferably strong enough to secure the tip 66 (FIG. 1) of the drill bit 30 (since the drill bit 30 is vertically position), but not too strong so as to require an unreasonable amount of force to pull the drill bit 30 away from the bottom 3 of the housing.

Figure 5:
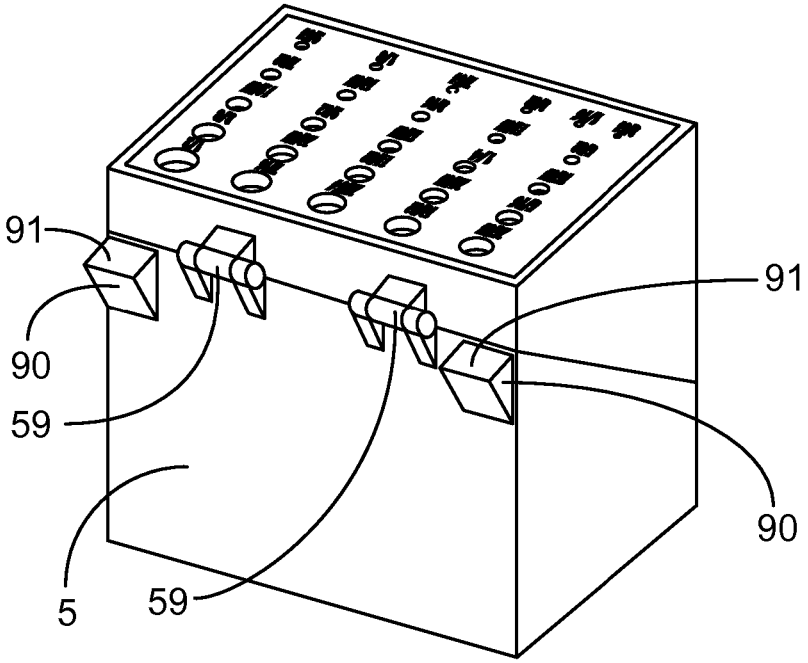
FIG. 5 illustrates a perspective view of the back of the drill bit gauge and storage box wherein the hinges and the back protrusions (or "stops") are visible.

In an embodiment, the back 5 of the housing may have at least one hinge 59 (FIG. 5). The hinge(s) 59 may allow the top 2 of the housing to rotate up and back with respect to the bottom 3 and sides 6, 7 of the device 1. In an embodiment, at least one stop 90 may be located on the back 5 of the device 1. The stop 90 may be generally triangular having a top surface 91 which prevents the top 2 from rotating backward past a predetermined point. In an alternate configuration, the stop(s) 90 may be integral with the hinge.

Figure 6:
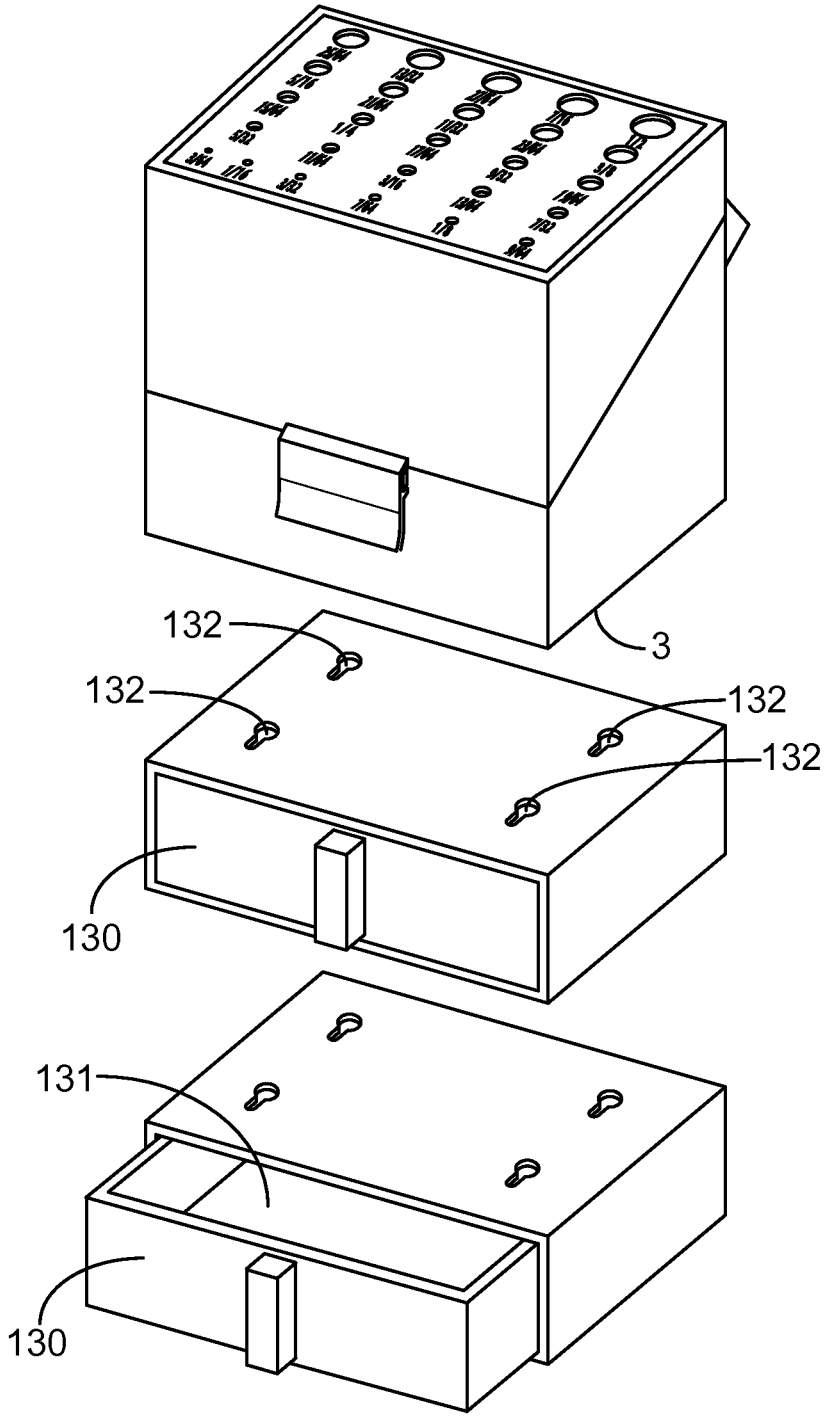
FIG. 6 illustrates an exploded view of an embodiment of the drill bit gauge and storage box wherein removable drawers are in the process of being secured to or removed from the bottom of the box.
Figure 7:
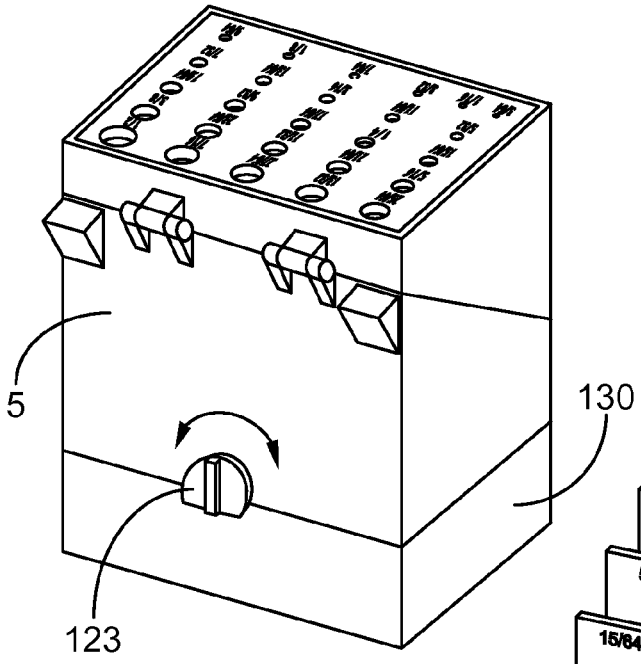
FIG. 7 illustrates a perspective view of the back of the drill bit gauge and storage box wherein a locking latch is illustrated.

Referring now to FIG. 6, in an alternative embodiment, a drawer housing and drawer assembly 130 (or a plurality of drawer assemblies 130) having an interior 131, may be temporarily secured to the bottom 3 of the drill bit gauge and storage box 1. The drawer(s) 130 may be located under the bottom 3 surface (the surface which supports the drill bits 30 within the interior 8 of the device 1). The drawer(s) 130 may be used to store various objects such as, for example, tools and the like. The drawers 130 may have keyhole openings 132 which lock into corresponding pins (not shown) located on an additional drawer 130 and/or on the bottom 3 of the device 1. The back 5 of the device 1 may have a rotating circular disk 123 (FIG. 7) having a flat surface which allows the independent drawers 130 to be locked to the bottom 3 of the device 1.

Figure 2:
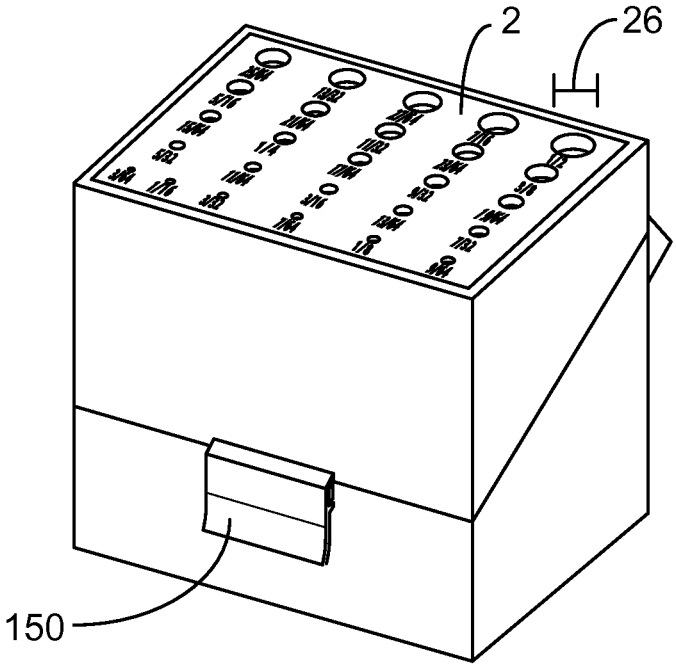
FIG. 2 illustrates a perspective view of the front of the drill bit gauge and storage box wherein the top surface portion is in the closed position and wherein each of the drill bit size openings on the top surface may be marked with the drill bit diameter dimension.

In an embodiment, the front 4 of the drill bit gauge and storage box 1 may have a latch 150 (FIG. 2). The latch 150 may temporarily secure the top 2 of the device 1 to the front 4 of the device 1 so that the top surface is in alignment with the corresponding bins below and not subject to lateral movement. Further, the latch on the device, once engaged, prevents the device 1 from accidentally opening, allowing the contents of the interior 8 of the device 1 to accidentally fall out. The latch is manually released when it is desired to gain access to the interior of the box.

Finally, as illustrated in FIG. 3, in an embodiment the underside of the removable top 2 may have partial cylinders 509 which extended downward from the openings 25. The partial cylinders 509 may direct the drill bits 30 into the proper holding bin 10. Further, in an embodiment, the partial cylinders 509 may extend to the top of the holding bins 10 so that no gap exists between the top of the holding bins 10 and the bottom of the partial cylinders 509.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

The invention claimed is:

1. A drill bit storage box having an integral gauge for determining the size of a drill bit comprising:

a housing having a top, a bottom, a front, a back, a first side, a second side and a generally hollow interior;

at least one opening located on the top wherein the opening has a diameter corresponding to a diameter of a drill bit and wherein the opening has a generally cylindrical extension extending down from the opening and into the generally hollow interior of the housing and wherein the generally cylindrical extension surrounds a circumference of the opening;

at least one holding bin located within the hollow interior of the housing wherein a drill bit inserted into the opening of the top falls into the holding bin;

indicia located on the top of the housing wherein the indica indicates which opening the drill bit is intended to be inserted into;

wherein the generally cylindrical extension of opening is capable of partially guiding and supporting drill bit;

wherein the top of the housing is removable and replaceable with an alternative top having openings of alternative sizes; and a hinge located on the back of the housing wherein the hinge allows the top of the housing to rotate backward while the top is still secured to the back of the housing and wherein the hinge is completely on the back of the housing such that no portion of the hinge extends into the interior of the housing.

2. The drill bit storage box of claim 1 wherein the opening of the top of the housing corresponds to a standard SAE drill bit size.

3. The drill bit storage box of claim 1 wherein the opening of the top of the housing corresponds to a metric drill bit size.

4. The drill bit storage box of claim 1 further comprising:

a plurality of drawers each having a front, a back, a first side, a second side and a bottom wherein the plurality of drawers are removably secured to the bottom of the housing.

5. The drill bit storage box of claim 1 further comprising:

a magnetic bottom wherein the magnetic bottom is attracted to and secures the drill bit.

6. The drill bit storage box of claim 1 wherein the top rotates approximately one hundred and twenty degrees backward with respect to the back of the housing.

7. The drill bit storage box of claim 1 further comprising:

a generally rectangular divider forming a portion of the holding bin located within the hollow interior of the housing wherein the generally rectangular divider is connected to a hinge and wherein the hinge allows the generally rectangular divider to rotate and therein alter the size of the holding bin.

8. The drill bit storage box of claim 1 wherein the first side and the second side of the housing is slanted forward so that the front of the first side and the front of the second side of the housing is smaller than the back of the first side and the back of the second side of the housing so as to allow a drill bit of greater size to be secured toward the back of the housing.

9. The drill bit storage box of claim 1 further comprising:

a latch on the front of the housing wherein the latch temporarily secures the top of the housing to the front of the housing.

10. The drill bit storage box of claim 1 further comprising:

a hook and loop fastener located along a ridge located within the interior of the housing near the top of the housing wherein the hook and loop fastener correspondingly mates with and temporarily secures the top of the housing.

11. The drill bit storage box of claim 1 further comprising:

a generally triangular stop located on the back of the housing wherein the generally triangular stop prevents the top of the housing from rotating backward past a predetermined point.

12. The drill bit storage of claim 11 further comprising:

a hinge at a crease between the back of the housing and the top of the housing wherein the hinge allows the top of the housing to rotate with respect to the back of the housing and wherein the generally triangular stop is connected to the hinge.

* * * * *